United States Patent [19]

Martel

[11] Patent Number: 4,804,159

[45] Date of Patent: Feb. 14, 1989

[54] SHELF BRACKET

[76] Inventor: André A. Martel, 84, des Pionnniers, Vaudreuil, Québec, Canada, J7V 5V5

[21] Appl. No.: 150,748

[22] Filed: Feb. 1, 1988

[51] Int. Cl.[4] ..... A47G 29/02

[52] U.S. Cl. ..... 248/248; 108/106; 108/152; 248/300

[58] Field of Search ..... 248/248, 247, 300, 235, 248/241, 242, 240, 240.3; 211/187; 108/106, 107, 152

[56] References Cited

U.S. PATENT DOCUMENTS

| | | | |
|---|---|---|---|
| 1,193,832 | 8/1916 | Seymoure | 248/240.3 |
| 1,270,718 | 6/1918 | Ford | 248/248 X |
| 1,952,111 | 3/1934 | Bales | 108/107 |
| 3,041,033 | 6/1962 | Schwartz | 248/248 |
| 3,184,068 | 5/1965 | Wende | 108/107 UX |
| 3,223,246 | 12/1965 | Daitch | 248/248 X |
| 3,432,134 | 3/1969 | Forschmidt | 108/152 X |
| 3,447,823 | 6/1969 | Gregoire | 248/300 X |
| 3,730,464 | 5/1973 | Kelly | 248/300 X |
| 3,994,462 | 11/1976 | Shine | 248/248 |

FOREIGN PATENT DOCUMENTS

| | | | |
|---|---|---|---|
| 2843028 | 4/1980 | Fed. Rep. of Germany | 248/248 |
| 0002398 | of 1908 | United Kingdom | 248/248 |
| 1126960 | 9/1968 | United Kingdom | 248/247 |

*Primary Examiner*—Ramon O. Ramirez

*Attorney, Agent, or Firm*—Roland L. Morneau

[57] ABSTRACT

A shelf bracket formed by a sheet of material having a rectangular front flange and a two triangular lateral flanges extending from two opposite sides of the rectangaular front flange. The two lateral flanges are folded towards each other along the said opposite sides of the front flange. The wide end of the lateral flanges are adapted to be fastened to an upstanding exposed stud. The upper edges of the three flanges are coplanar and adapted to support one end of a board to form a shelf.

6 Claims, 1 Drawing Sheet

SHELF BRACKET

BACKGROUND OF THE INVENTION

1. Field of the Invention

The present invention relates to a bracket adapted to be fixed to an exposed wood studding and over which a board is adapted to be laid for forming a shelf.

2. Prior Art

Shelf brackets are known to have various shapes and structures and adapted to be fixed in a variety of ways to, walls, partitions, pipes, studs or the like.

U.S. Pat. No. 3,041,033 is of particular interest because it is made of a folded sheet metal. The top surface of the bracket constitutes the central portion of the sheet metal when unfolded.

SUMMARY OF THE INVENTION

The shelf bracket according to the invention is essentially made of a sheet of rigid material forming two triangular plates connected at their apex by a substantially rectangular plate. One side of the triangular plates and the rectangular plate extend in a straight line and the triangular plates are adapted to be folded one against the other in a substantially parallel relationship along two opposite sides of the rectangular plate. The said sides of the triangular plates and rectangular plate forming a straight line extend in a plane when the triangular plates are folded one against the other.

The portion of each triangular plate opposite the apex are provided with holes for securing the shelf bracket against the sides of an upright stud. The upper and lower sides of the triangular plates are provided with reinforcing flanges.

DETAILED DESCRIPTION OF THE DRAWINGS

Figure 1:
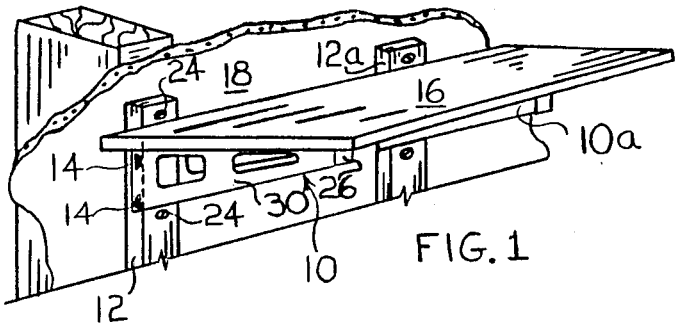
FIG. 1 is a perspective view of shelf supported by a shelf bracket according to the invention.
Figure 6:
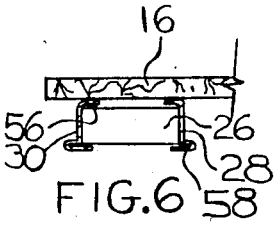
FIG. 6 is an enlarged cross-sectional view of the bracket taken along line A—A of FIG. 2.

FIG. 1 illustrates a shelf bracket 10 according to the invention which is mounted on an upstanding exposed stud 12 and fixed thereto with screws 14. The shelf is completed by laying a board 16 over a pair of shelf bracket 10 and 10*a* mounted on the same level on an adjacent exposed stud 12*a*.

The stud 12 is exposed over a wall surface 18 so as to exposed two sides 20 and 22 (FIG. 4) on which the screws 14 are fastened. The upstanding exposed stud 12 is fixed to the wall 18 by screws 24.

Figure 5:
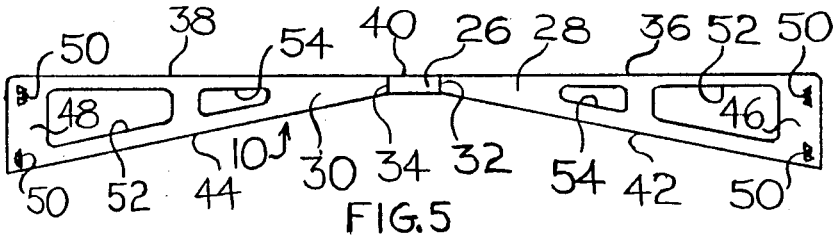
FIG. 5 is a side plan view of an unfolded shelf bracket.

The bracket per se 10 is illustrated in FIG. 5 in its unfolded shape.

It is essentially made of a single piece of material and consists of a substantially rectangular front flange 26 and two substantially triangular flanges 28 and 30 which extends from their apex to opposite sides 32 and 34 of the rectangular flange 26. The apex of the triangular flanges 28 and 30 are flat and have a length equal to the length of the sides 32 and 34. The sides 36 and 38 of the triangular flanges 28 and 30 are colinear with the side 40 of the rectangular flange 26. The lower edge 42 and 44 of the triangular flanges 28 and 30 are illustrated by straight lines but can be convex or compound concavo-convex lines.

Figure 3:
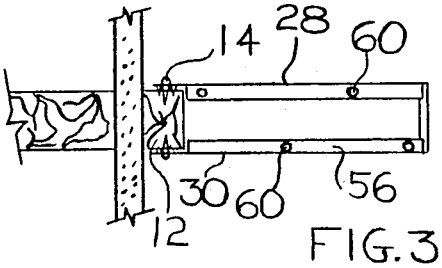
FIG. 3 is a top plan view of the shelf bracket shown in FIG. 2 without the board on the bracket.
Figure 2:
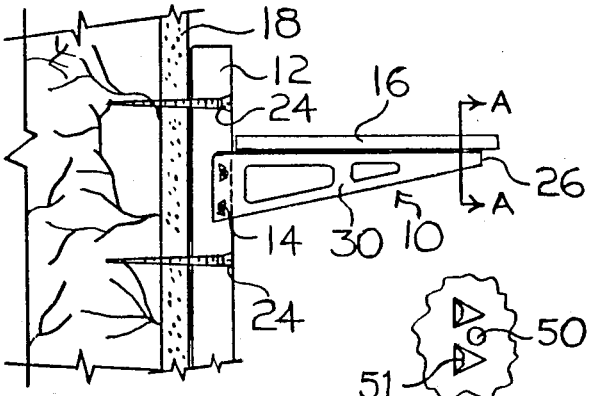
FIG. 2 is a vertical cross-sectional view taken through the shelf of FIG. 1.
Figure 7:
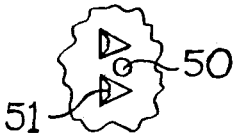
FIG. 7 is an enlarged view of the claws in the wide end of the bracket.
Figure 4:
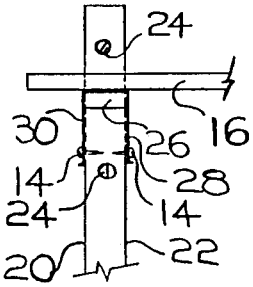
FIG. 4 is a front plan view of the bracket shown in FIG. 2.

The bracket 10 is made of a material which is weakened along the lines formed by the sides 32 and 34 to facilitate the folding of the two triangular flanges 28 and 30 one toward the other to reach a substantially parallel position as illustrated in FIGS. 3 and 4. Both ends 46 and 48 of the bracket 10 which are located at the wide end of the triangular flanges 28 and 30 are provided with an aperture 50 for receiving screws 14 adapted to fixed the shelf bracket to the stud 12.

The portion of the triangular flanges 28 and 30 adjacent the aperture 50 are provided with sharp claws 51 for initiating the retention of the triangular flanges onto the stud 12. These claws when hammered are sufficient to retain the bracket on the stud 12 while fastening the screws into the stud 12. If the bracket is made of metal, such claws 51 may be punched out of the material itself in the form of a triangular prongs.

Depending on the gauge or the rigidity of the material, cut-outs such as 52 and 54 are provided through the rectangular flanges 28 and 30. The size of the cut-outs 52 and 54 depends also on the maximum weight which is recommended to be supported by the board 16.

In order to add additional strength to the bracket 10, the upper edges 36 and 38 of the triangular flanges 28 and 30 are provided with a folded lip 56 while the lower edges 42 and 44 are folded to provide a double lip 58. The lips, 56 as shown in FIG. 3, are provided with apertures 60 to allow the passage of screws for retaining the board 16.

The bracket may be made out of sheet metal or plastic.

The present arrangement is of particular interest because it can be adapted on studs having a variety of width. For instance, the same bracket may be mounted on studs measuring two by two inches or three quarter by one and a half inches. The two triangular flanges 28 and 30 do not have to be exactly parallel to each other and because they are made of a relatively flexible material may be adapted to the width of the stud 12. Because the wood, nowadays, is quite often still green when used as building material, it shrinks when it dries up. The present bracket will easily follow the shrinking of the wood and will not loosen up. It will not be difficult to adjust and tightened the wide ends 46 and 48 on the sides of the stud 12. The fact that it will not loosen up is a particular advantage over other bracket which are shaped with a specific and non-adjustable dimension in width.

I claim:

1. A shelf bracket adapted to be mounted on an upstanding exposed stud, the said bracket comprising, a substantially rectangular front flange having two opposed parallel sides, and two laterally spaced flanges having a generally triangular shape, said triangular shape being truncated at its apex to form a flat side across its apex, said flat sides co-extending with each of said parallel sides and foldingly connected thereto along said parallel sides, said spaced flanges being angularly movable relative to each other of the front flange and of the two spaced flanges having a collinear top edge defining a single plane, the height of said spaced flanges corresponding substantially to said parallel sides the end of the spaced flanges remote from the front panel being adapted to be fastened to the sides of an upstanding exposed stud whereby said spaced flanges are adapted to be angularly displaced from each other about said opposed parallel sides of the front flange.

2. A shelf bracket as recited in claim 1, wherein the spaced flanges have a reinforcing lip extending along their top and bottom edges.

3. A shelf bracket as recited in claim 1, wherein the said remote ends of said spaced flanged are provided with apertures for receiving fastening means for engaging the said exposed stud.

4. A shelf bracket as recited in claim 2, wherein the said remote ends are provided with sharp claws projecting towards each other for gripping said stud.

5. A shelf bracket as recited in claim 2, wherein said spaced flanges are provided with central cut-outs.

6. A blank sheet for forming a shelf bracket adapted to be mounted on an upstanding exposed stud, the said blank sheet comprising, a substantially rectangular central face having two opposed parallel sides, two lateral faces having a generally triangular shape, said triangular shape being truncated at its apex to form a flat side across its apex, said flat sides coextending with each of said parallel sides and foldingly connected thereto along said parallel sides, lateral sides of said central face and of each of said lateral faces being colinear, the intersection of said central face and said lateral faces along said opposed parallel sides being provided of a material of weakened resistance for facilitating the folding of said lateral faces relative to said central portion one toward the other, whereby the said opposite end of said lateral faces remote from said central face are adapted to be fastened to the side of a stud.

* * * * *